US007699646B2

(12) United States Patent
Zhu et al.

(10) Patent No.: US 7,699,646 B2
(45) Date of Patent: Apr. 20, 2010

(54) CABLE CONNECTOR ASSEMBLY

(75) Inventors: Qing-Man Zhu, Kunshan (CN); Xue-Liang Zhang, Kunshan (CN); Er-Hou Zhou, Kunshan (CN); Chien-Chiung Wang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/380,176

(22) Filed: Feb. 23, 2009

(65) Prior Publication Data

US 2009/0215290 A1 Aug. 27, 2009

(30) Foreign Application Priority Data

Feb. 22, 2008 (CN) ..... 2008 2 0032295 U

(51) Int. Cl.
*H01R 12/24* (2006.01)

(52) U.S. Cl. ..... 439/493

(58) Field of Classification Search ..... 439/493, 439/497, 579, 607.46, 607.41
See application file for complete search history.

(56) References Cited

U.S. PATENT DOCUMENTS 5,158,474 A * 10/1992 Frantz ..... 439/362
6,290,532 B1 9/2001 Vermeersch et al.
7,179,117 B2 * 2/2007 Wu ..... 439/460

* cited by examiner

*Primary Examiner*—Phuong K Dinh
(74) *Attorney, Agent, or Firm*—Ming Chieh Chang; Wei Te Chung; Andrew C. Cheng

(57) ABSTRACT

A cable connector assembly (100) has a terminal connector (3), a number of cables (1) connected to the terminal connector, an outer shell (71) defining an interior space (710) receiving the terminal connector, an inner shell (70) and a wire spacer (5). The terminal connector includes an insulative base (302) having a number of terminals (303) mounted therein, a shield (301) enclosing the insulative base and a printed circuit board (31) having a number of pads (311, 312) disposed thereon and arranged in two rows. The wire spacer partially extends out of the outer shell (71) and has a number of parallel passages for extension of the cables and organization of the number of cables.

1 Claim, 4 Drawing Sheets

CABLE CONNECTOR ASSEMBLY

BACKGROUND OF THE INVENTION

1. Field of the Invention

The present invention relates to a cable connector assembly, and more particularly to a cable connector assembly having an improved wire spacer.

2. Description of the Prior Art

A conventional high-speed cable assembly always has an outer shell defining an interior space, a dielectric housing having a plurality of contacts mounted thereto, a printed circuit board attached to a rear side of the housing for connecting with rear ends of the contacts, and a plurality of wires extending through a wire spacer and mounted to an end portion of the printed circuit board. The dielectric housing, the printed circuit board and the wire spacer are entirely received in the interior space of the outer shell. Typically, when the cable assembly is mounted to an external electronics equipment like server or switch, the wires of the cable assembly extending out of the outer shell without any stress buffer for reducing a pressure loadings of the cables of the wires. As a result, it is easy to cause instability and damages of the cable assembly which is subjected to pressure loadings of the cables.

Hence, an improved cable connector assembly is needed to solve the above problem.

BRIEF SUMMARY OF THE INVENTION

One object of the present invention is to provide a cable connector assembly comprising an improved wire spacer not only for organizing a plurality of cables but also for serving as a cable stress buffer.

The present invention provides a cable connector assembly, comprising a terminal connector, a plurality of cables connected to the terminal connector, an outer shell defining an interior space receiving the terminal connector, an inner shell and a wire spacer. The terminal connector includes an insulative base having a plurality of terminals mounted therein, a shield enclosing the insulative base and a printed circuit board having a plurality of pads disposed thereon and arranged in two parallel rows. The wire spacer partially extends out of the outer shell and comprises a plurality of parallel passages for extension of the cables and organization of the plurality of cables.

Advantages of the present invention are to provide a wire spacer partially extending out of the outer shell to act as a cable stress buffer and defining a number of passages for organizing a plurality of cables. The reliability of the cable connector assembly is increased because the wire spacer provides a protection force. Additionally, the wire spacer serves as a cable stress buffer for lowering the costs of production.

Other objects, advantages and novel features of the invention will become more apparent from the following detailed description of the present embodiments when taken in conjunction with the accompanying drawings.

DETAILED DESCRIPTION OF THE INVENTION

Figure 1:
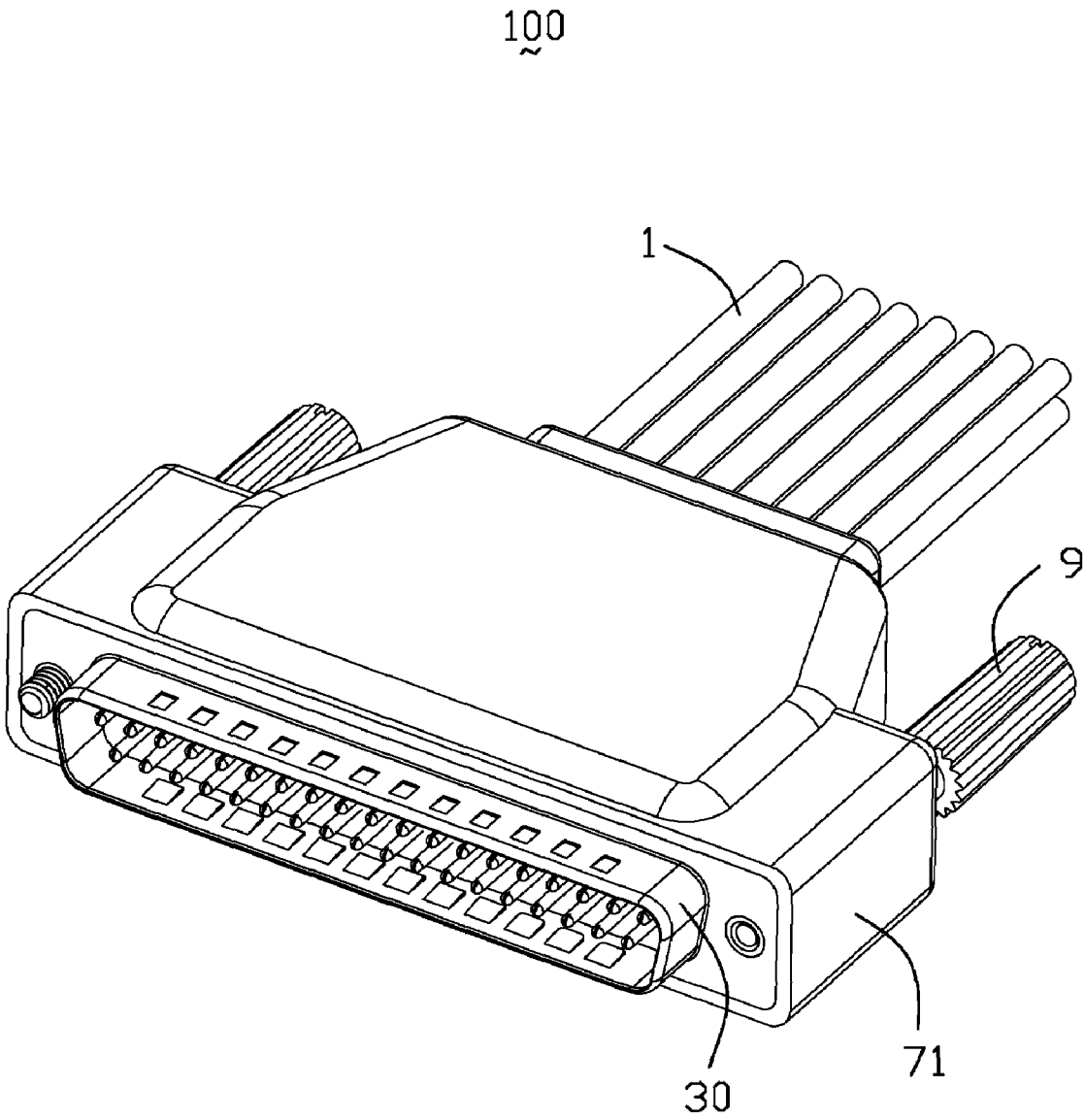
FIG. 1 is an assembled perspective view of a cable connector assembly in accordance with the present invention.
Figure 2:
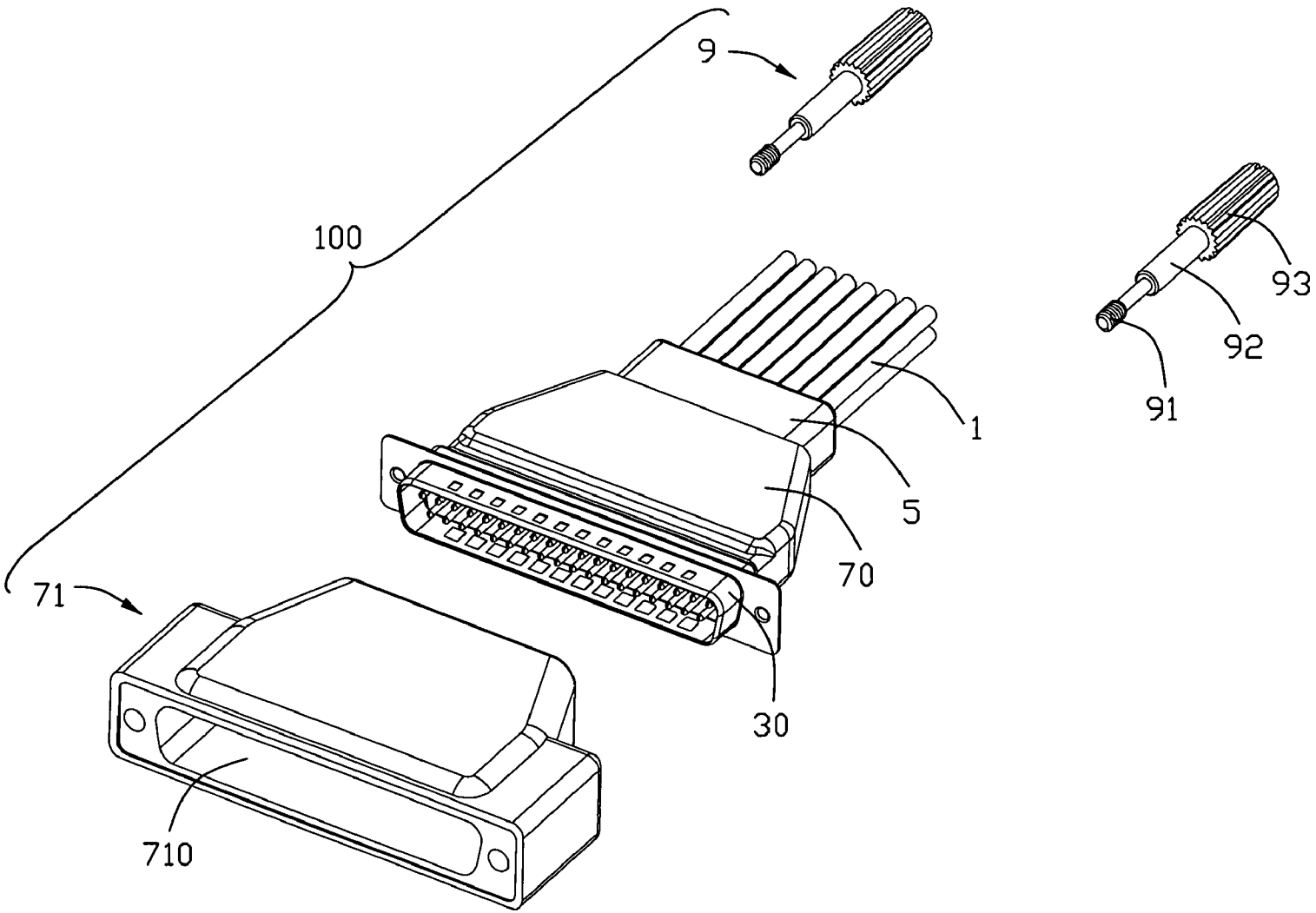
FIG. 2 is a partially assembled perspective view of the cable connector assembly.
Figure 3:
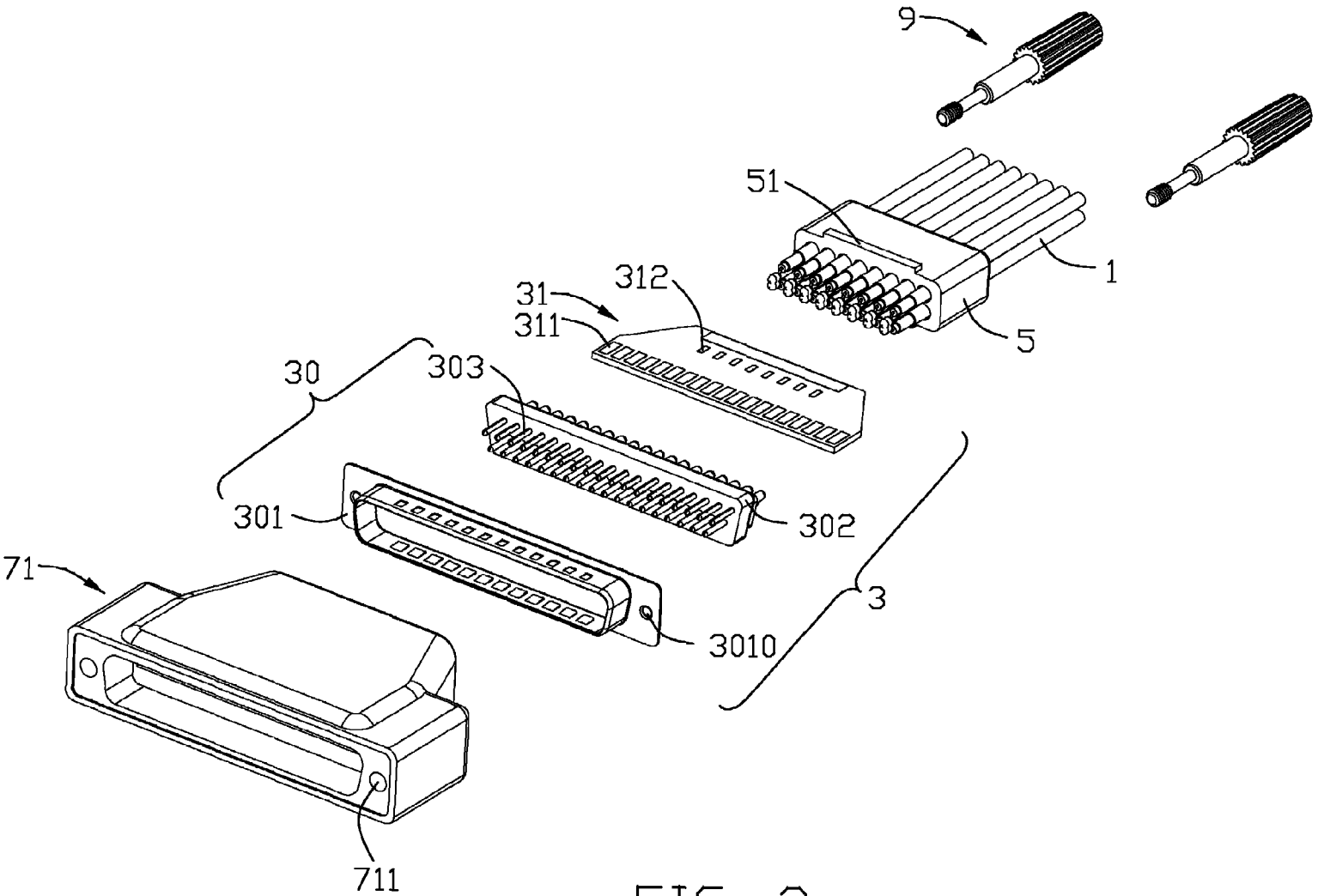
FIG. 3 is an exploded view showing the cable connector assembly but not showing an inner shell.
Figure 4:
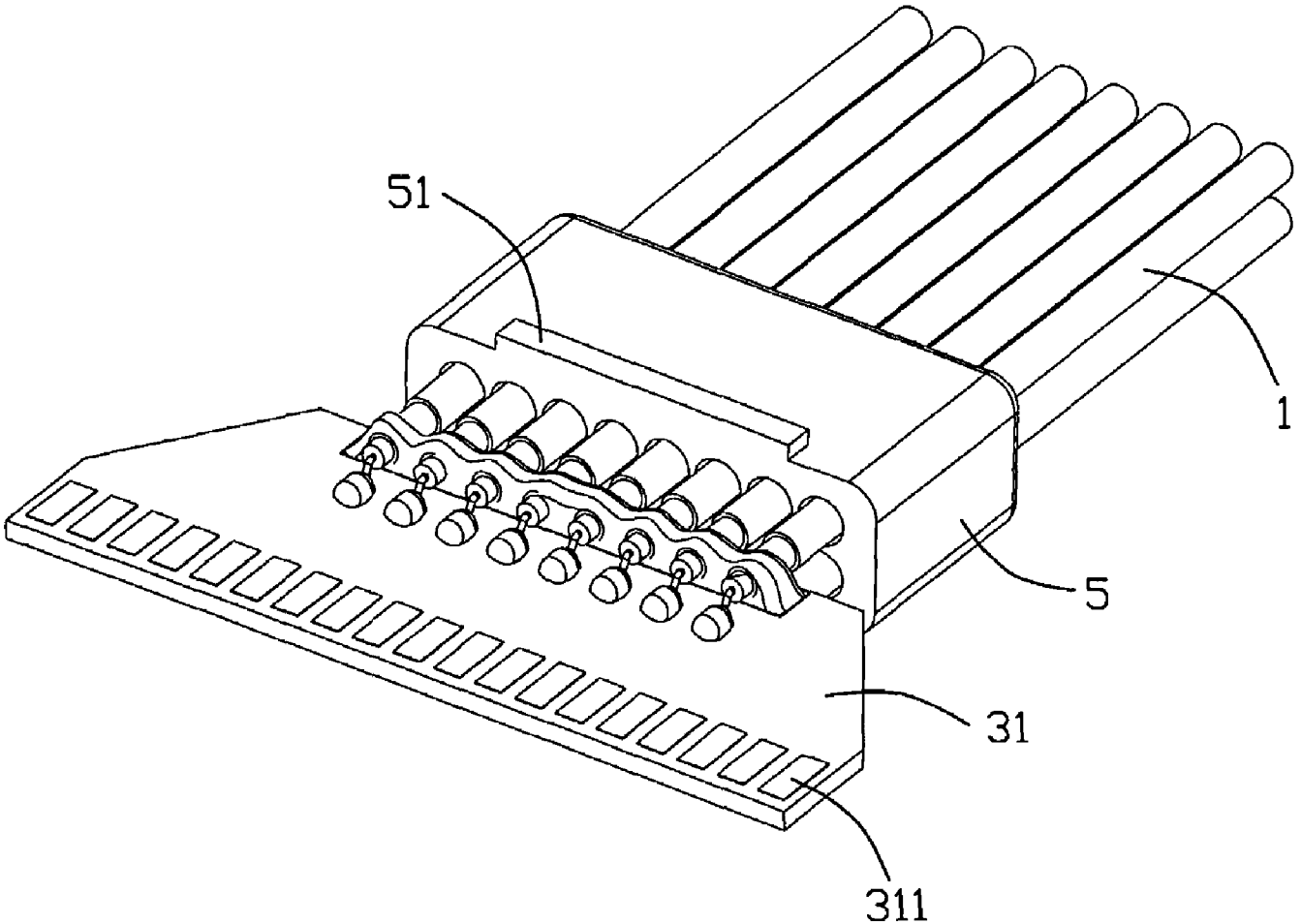
FIG. 4 is a perspective view of the cables extending out of a wire spacer and being connected to a printed circuit board.

Reference will now be made to the drawing figures to describe the present invention in detail. Referring to FIGS. 1-3, a cable connector assembly 100 comprises a terminal connector 3 mating with a complementary connector (not shown), a plurality of cables 1, an inner shell 70, an outer shell 71 having an interior space 710 and a wire spacer 5 partially received into the outer shell 71.

Referring to FIG. 3, the terminal connector 3 has an insulative base 302 having a plurality of terminals 303 mounted therein, a shield 301 enclosing the insulative base 302 for avoiding electrical magnetic interference and a printed circuit board 31 having a plurality of pads 311 and 312 disposed thereon and arranged in two parallel rows. The terminals 303 extend through the insulative base 302 and respectively provide an end portion 3032 connecting to the front pads 311 of the printed circuit board 31.

The wire spacer 5 is of a rectangular shape and comprises a number of passages (not labeled) arranged in two parallel groups for extension of the cables 1. Each passage has a shape conforming to a cross-section of an outside surface of the cable 1. The wire spacer 5 partially extends out of the outer shell 71 to act as a cable stress buffer and further has a flange 51 disposed thereon for locking with the inner shell 70.

The printed circuit board 31 and a front part of the wire spacer 5 has insulative material molded therearound to form the inner shell 70 which is not shown in FIG. 3. The outer shell 71 comprises a pair of first holes 711 placed on opposite lateral portions thereof. The shield 301 has a pair of second holes 3010 in alignment with the first holes 711. The cable connector assembly 100 further comprises a pair of fastening members 9 being movably secured into the second holes 3010 and first holes 711. The fastening member 9 has a head portion 91 for screwing to the complementary connector, a medial portion 92 and a grab portion 93 extending from the medial portion 92.

During assembly, firstly, the shield 301 retains the insultive base 302 therein. The end of the terminals 3032 are connected to the front pads 311 of the printed circuit board 31. Secondly, the cables 1 are assembled to the corresponding passages of the wire spacer 5 and terminated to the end pads 312 of the printed circuit board 31. Thirdly, the inner shell 70 is molded around the printed circuit board 31 and the front part of the wire spacer 5 and locked with the flange 51 of the wire spacer 5. The outer shell 71 encloses the terminal connector 3, the printed circuit board 31, the inner shell 70 and front part of the wire spacer 5. Finally, the pair of fastening members 9 being movably secured into the second holes 3010 and first holes 711. The rear portion of the wire spacer 5 extends out of the outer shell 71 to serve as a stress buffer for increasing a reliability of the cable connector assembly and providing a protection force for the cables.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A cable assembly, comprising:

a terminal connector, comprising:

an insulative base having a plurality of terminals mounted therein;

a shield enclosing the insulative base; and a printed circuit board having a plurality of pads disposed thereon and arranged in two rows;

a plurality of cables connected to the printed circuit board at a first position;

an inner shell surrounding the printed circuit board;

an outer shell defining an interior space receiving the terminal connector; and a wire spacer partially extending out of the outer shell and comprising a plurality of parallel passages for extension of the cables and organization of the plurality of cables, said first position being disposed outside of the wire spacer and the shield, and shielded by the inner shell.

* * * * *